US006957024B2

(12) United States Patent
Shinkawa et al.

(10) Patent No.: US 6,957,024 B2
(45) Date of Patent: Oct. 18, 2005

(54) IMAGE FORMING DEVICE, TONER AND COPY

(75) Inventors: Kohji Shinkawa, Kitakatsuragi-gun (JP); Hideyuki Nishimura, Katano (JP); Takeshi Murata, Sakai (JP); Satoshi Machino, Jyoyo (JP); Keiko Yutani, Ikoma (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/423,964

(22) Filed: Apr. 28, 2003

(65) Prior Publication Data

US 2003/0215249 A1 Nov. 20, 2003

(30) Foreign Application Priority Data

May 16, 2002 (JP) ..... 2002-141514

(51) Int. Cl.[7] ..... G03G 15/00

(52) U.S. Cl. ..... 399/49; 399/252

(58) Field of Search ..... 399/24, 27, 28, 399/46, 49, 60, 72, 252; 430/106.1, 107.1, 108.1, 108.6, 111.41

(56) References Cited

FOREIGN PATENT DOCUMENTS

| | | | |
|---|---|---|---|
| JP | 01-167867 | * | 7/1989 |
| JP | 6-35237 | | 2/1994 |
| JP | 2000-212208 | * | 2/2000 |

* cited by examiner

*Primary Examiner*—Hoang Ngo
(74) *Attorney, Agent, or Firm*—Nixon & Vanderhye, P.C.

(57) ABSTRACT

An image forming device 1 comprises an electrophotographic processing unit 48 equipped with a developer 44 including a developing agent containing black toner having infrared reflectiveness, and forms an image having infrared reflective property. The image forming device 1 further comprises a detector 51 for detecting whether the formed toner image has infrared reflective property or not and a control unit for controlling each unit based on the result of detection by the detector 51, so as to form a black image having infrared reflective property in a reliable manner.

26 Claims, 4 Drawing Sheets

IMAGE FORMING DEVICE, TONER AND COPY

FIELD OF THE INVENTION

The present invention relates to a toner, an image forming device and a copy formed by the image forming device utilizing black organic pigments having infrared reflectiveness.

DESCRIPTION OF THE RELATED ART

In general, a substance called carbon black is used for black-colored pigments in a black-colored toner provided to an image forming device for developing image data. Normally, the black color has a property to absorb light, so the black pigments containing carbon black also have the optical property to absorb light including ultraviolet radiation and infrared radiation. Therefore, if a copied object having an image formed thereto using a black-colored toner containing carbon black is exposed to ultraviolet radiation and infrared radiation, the copy absorbs the ultraviolet and infrared radiations.

Along with the recent technical advancement in the field of image forming, copies formed with the recent image forming technology have become more and more sophisticated, making it difficult to distinguish the copy from the original. This has lead to increase of crimes committed by copying and forging securities and bills, the copying of which being prohibited by law, using image forming devices.

By using black-colored pigments having ultraviolet or infrared reflectiveness in a black toner, a copied object having an optical property different from that of the original can be obtained. When such black toner having ultraviolet/infrared reflectiveness is used to copy bills and the like, one can tell easily whether the bill is an original or a forgery (copy) by detecting the optical property of the object.

Ultraviolet must be radiated in order to determine whether the black toner has ultraviolet reflective property or not, which causes a problem since ultraviolet is difficult to handle and safety measures must be taken.

SUMMARY OF THE INVENTION

The present invention aims at solving the problems of the prior art mentioned above. The object of the invention is to provide an image forming device capable of creating a copy using a black toner having a property to reflect infrared radiation, which can be handled easily, making it possible to discriminate a copy from an original, and further capable of preventing erroneous use of black toners without infrared reflectiveness for other image forming devices.

The image forming device according to the present invention comprises an electrophotographic processing unit equipped with a developing agent including a black toner having infrared reflectiveness. Furthermore, the device comprises a detector for detecting whether a toner image formed by the electrophotographic processing unit has infrared reflectiveness or not, and a control unit for controlling the operation of each unit according to the result of detection by the detector.

According to the image forming device of the present invention, an image data obtained for example by reading the image of an original document by a scanner is converted into an electrostatic latent image, and the latent image is developed using a developing agent containing a black toner having infrared reflectiveness, thereby forming an image having infrared reflectiveness on a recording medium such as a sheet of paper. The device further comprises a detector equipped with an infrared emitting element and an infrared receiving element for detecting whether the black toner has infrared reflectiveness or not, and a control unit for controlling various units according to the result of the detection by the detector, so that a black colored image having infrared reflectiveness is formed without fail.

A black colored image generally has a property to absorb infrared radiation. However, a copy obtained by the above image forming device has a property to reflect infrared radiation by the black colored image, thus enabling the copy to be distinguished easily from the original. Therefore, even if securities or bills have been copied cunningly for forgery, and even if the copies cannot be distinguished from the original through the human eye, the copy can be distinguished easily by checking infrared reflectiveness. However, the obtained copy visually looks exactly the same as the original, so the image quality of the copy is not degraded.

Moreover, according to the above configuration, the detector can notify the user when a black toner containing conventional carbon black pigments is mounted and used in the present device. This aspect of the device prevents the erroneous use of black toners other than the toner having infrared reflectiveness dedicated for use in the present image forming device, and enables a most suitable image to be formed corresponding to the property of the dedicated black toner.

As a result, the present device enables to prevent forgery of securities, bills, etc.

Moreover, the image forming device of the present invention comprises a display means for displaying the result of detection performed by the detector.

According to the above construction, if a black toner having no infrared reflectiveness is used, the detected result can be displayed on a display means such as a manipulation panel so as to prevent images from being formed. Since images will not be formed using a black toner that is not dedicated for use in the present image forming device, only copies having infrared reflectiveness are formed by the device, according to which forgery of securities and bills can be prevented. Furthermore, since images are formed using a black toner suited for use by the image forming device, high quality images can be obtained.

A document image reader according to the present invention is equipped with a means for detecting whether the original image has infrared reflectiveness or not, and a control unit for controlling a display means to display the result of detection.

According to this construction, whether the original being read in includes a black image having infrared reflectiveness or not can be determined easily.

Therefore, if a user uses the above-mentioned image forming device to make a copy of an original document for which no secondary copy should be formed, it becomes possible to restrict copying of said copy (in other words, secondary copying) using this image forming device.

The black toner used in the present image forming device contains an azomethine black organic pigment as an infrared reflective black organic pigment.

According to this construction, infrared reflectiveness can be provided to the black toner for the present image forming device. Furthermore, since the infrared-reflective black organic pigments containing azomethine black organic pigments do not look any different from the carbon black pigments conventionally used, they are preferably used in the image forming device of the present invention.

The black toner is characterized in containing as binder resin at least one material selected from the group consisting of polyester, styrene acrylic butadiene copolymer polystyrene, polyurethane, polyethylene and polypropylene.

According to this construction, the infrared-reflective black pigments have advanced dispersibility and pigmentation property to the binder resin. Further, the obtained toner has preferable electrostatic property and developing property.

Further, the ratio of infrared-reflective black organic pigments to the binder resin is in the range of 0.5 percent by weight to 15 percent by weight.

According to this construction, the infrared-reflective black pigments have even better dispersibility and pigmentation property to the binder resin.

The copy (copied object) according to the present invention is a copy formed by creating an image using a developer containing at least a black organic pigment having infrared reflectiveness, and by reflecting infrared radiation, the copy can be distinguished from a copy formed using a developer containing normal black organic pigments.

Since according to this construction, the copy of the present invention has a property different from that of ordinary images in that the black image of the present copy reflects infrared radiation, so the copy can be distinguished easily from other general black copies that absorb infrared radiation. Therefore, even if securities or bills are copied cunningly for forgery and the forged copies are impossible to distinguish from the original through the human eye, the copies can be distinguished easily by exposing to infrared radiation. The copy is visually identical to the original, so the quality of the image is not degraded.

DETAILED DESCRIPTION OF THE PREFERRED EMBODIMENT

Figure 1:
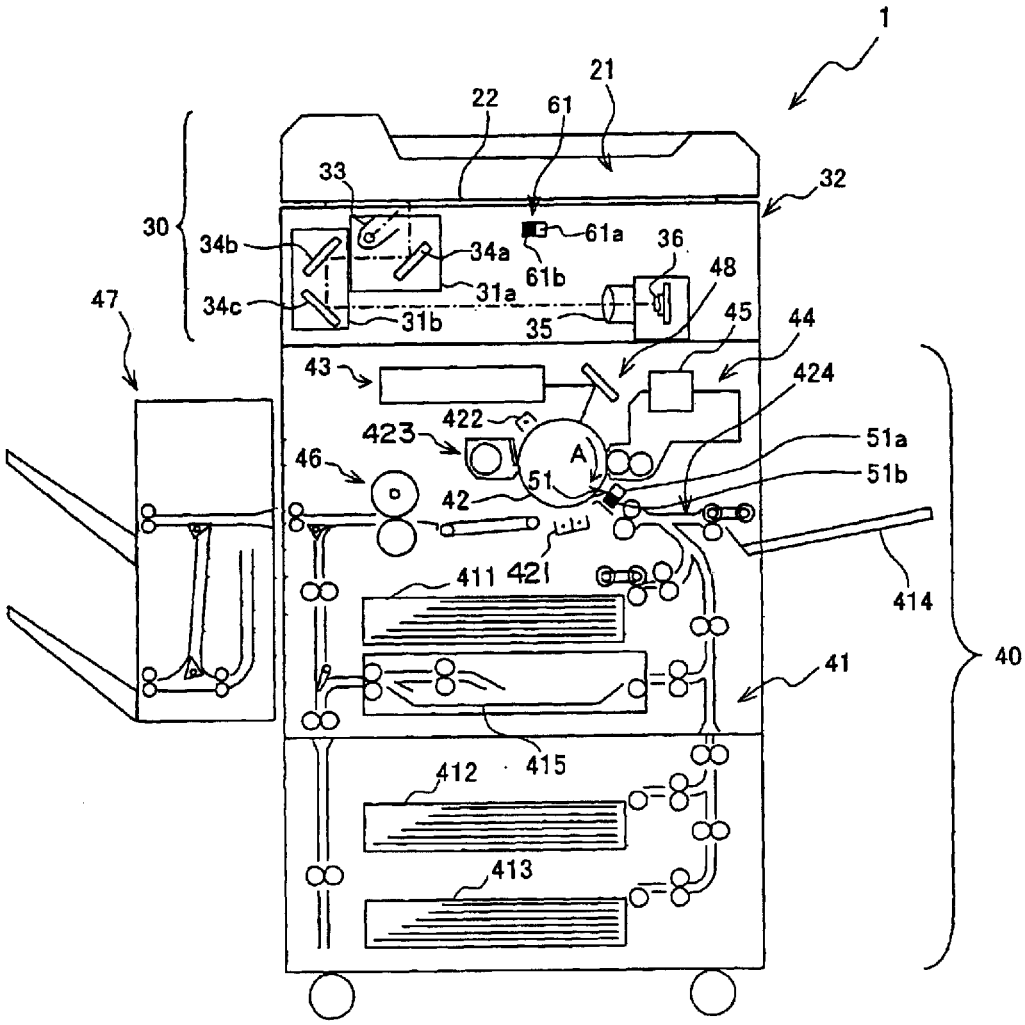
FIG. 1 is an explanatory view showing the whole construction of the image forming device according to the present invention.

Preferred embodiments of the present invention will now be explained with reference to FIGS. 1 through 3. However, the present invention should not be limited by the examples described in the embodiments.

First, the construction of the image forming device according to the present invention will be explained with reference to FIG. 1. FIG. 1 is a cross-sectional view illustrating the structure of a digital copying machine 1 equipped with a black toner having infrared reflectiveness, which corresponds to the image forming device of the present invention.

The digital copying machine 1 is roughly composed of an image reading device 30 and a laser recording unit 40.

The image reading device 30 comprises a document mounting table 22 formed of transparent glass, a reversing automatic document feeder (transfer means: hereinafter referred to as RADF) 21 for automatically transmitting and supplying the document onto the document table 22, and a document image reading unit or scanner unit 32 for scanning and reading the image of the document mounted on the document table 22.

The document image being read through the image reading device 30 is transmitted as image data to an image processing unit not shown, and the image data is subjected to a predetermined image processing.

The RADF 21 is a device for automatically supplying a single sheet of document at a time on the document mounting table 22 positioned above the scanner unit 32 from a plurality of documents set on a document tray not shown. The RADF 21 is composed of a transfer path for a one-sided document, a transfer path for a double-sided document, a transfer path switching means, a group of sensors for controlling and managing the status of the document passing each unit, and a control unit for controlling the transfer, enabling either one side or both sides of a document to be read through the scanner unit 32 according to the choice of the user.

The scanner unit 32 for reading the image of the document on the document table 22 comprises a lamp reflector assembly 33 for exposing the document surface, a first scanner unit 31*a* equipped with a first reflecting mirror 34*a* for reflecting the reflection from the document and guiding the reflected optical image from the document to a charge coupled device (CCD) 36, a second scanner unit 31*b* equipped with second and third reflecting mirrors 34*b* and 34*c* for guiding the reflected optical image from the first reflecting mirror unit 34*a* to the charge coupled device (CCD) 36, an optical lens 35 for focusing the image on the CCD 36, and a charge coupled device (CCD) 36 for converting the reflected optical image from the document to electrical image data.

The image reading device 30 operating in connection with the RADF 21 and the scanner unit 32 is constructed to read the document image by positioning documents to be read in on the document table 22 sequentially and moving the scanner unit 32 along the lower face of the document table 22.

Especially, the first scanner unit 31*a* is driven from left to right along the document table 22 at a fixed speed V, and the second scanner unit 31*b* moves in the same direction in parallel there with at a speed of V/2 to the above fixed speed V.

Thereby, the image of the document mounted on the document table 22 is sent line by line in sequential manner to be focused on the CCD 36 for reading.

The image data obtained through the scanner unit 32 is transmitted to the image processing unit, where they are subjected to various processes before being stored temporarily in a memory of the image processing unit. Thereafter, in response to an output demand, the image stored in the memory is read out and transferred to a laser recording unit 40, where the image is formed on a recording sheet.

The laser recording unit 40 is equipped with a transfer system 41 for transferring sheets, which are recording members onto which images are to be formed, a laser writing unit 43, and an electrophotographic processing unit 48 for forming the image.

The laser writing unit 43 comprises a semiconductor laser source for radiating laser beams corresponding to the image data being input through the scanner unit 32 and read out from the memory or being transferred from an outside device, a polygonal mirror for performing equiangular rate deflection of the laser beam, and a f-θ lens for correcting the laser beam being deflected at equiangular rate so that the laser beam is deflected at equiangular rate on a photosensitive drum contained in the electrophotographic processing unit 48.

The electrophotographic processing unit 48 comprises a photosensitive drum 42, and further comprises a charger 422, a developer 44, a first infrared detecting unit 51, a transfer device 421, a cleaning unit 423 and a diselectrifying unit (not shown), which are disposed around the photosensitive drum 42.

An electrostatic latent image is formed on the surface of the photosensitive drum 42 while it rotates in the direction of arrow A. The charger 422 electrifies the photosensitive drum 42 before the formation of the latent image. The developer 44 develops the electrostatic latent image using a black colored toner. The developer 44 comprises a toner casing 45 storing a toner cartridge. The toner casing 45 stores the black toner having infrared reflectiveness dedicated for use in the image forming device 1. The black toner having infrared reflectiveness will be described in detail later.

A first infrared detecting unit 51 is disposed at a lower stream aid of the developer 44. The first infrared detecting unit 51 comprises an infrared emitting element 51*a* and an infrared receiving element 51*b*. The element 51*a* radiates infrared onto the toner image formed on the photosensitive drum 42. The infrared receiving element 51*b* senses whether the infrared radiation has been reflected by the toner or not by receiving infrared radiation. The transfer device 421 transfers the toner image being formed on the photosensitive drum 42 to a recording medium such as a sheet of paper. The cleaning unit 423 cleans the photosensitive drum 42 after the transfer process is completed. The diselectrifying unit (not shown) diselectrifies the photosensitive drum 42.

On the other hand, the transfer system 41 comprises a transfer unit 424 for transferring the sheet to an electrophotographic processing unit for image forming, especially to a transfer position where the transfer unit is disposed, cassette feeders 411, 412 and 413 for feeding sheets to the transfer unit 424, a manual feeder 414 for manually feeding sheets of other necessary sizes, a fixing unit 46 for fixing the image (especially the toner image) formed on the sheet after the transfer process, and a resupply path 415 for resupplying the sheet for forming an image on the back surface of the sheet after the fixing process.

Moreover, an after treatment device 47 for receiving a sheet P on which image is recorded and performing a predetermined treatment to this sheet is disposed on the lower stream side of the fixing unit 46.

The image data read out from the memory is formed as an electrostatic latent image on the surface of the photosensitive drum 42 within the electrophotographic processing unit 48 by scanning laser beams thereon through the laser writing unit 43. Thereafter, the electrostatic latent image is developed as a toner image at the electrophotographic processing unit 48.

The steps for developing the image at the electrophotographic processing unit will now be explained.

The photosensitive drum 42 having an electrostatic latent image formed on the surface thereof rotates in the arrow A direction, and the developer 44 provides toner that is attracted to the electrostatic latent image portion. The toner image attracted to the photosensitive drum 42 is observed by the first infrared detecting unit 52 to check whether it has infrared reflectiveness or not. When it is detected that the toner image has infrared reflectiveness, the toner image is transferred onto the sheet transferred from the transfer unit 424 by the transfer device 421.

Thus, the image visualized by the toner is electrostatically transferred onto a sheet (paper) transmitted from a paper feed portion of the multistage paper feed unit, and fixed thereto. Then, the paper (sheet) having the image formed thereto is transferred from the fixing unit 46 to the after treatment device 47 via an eject roller.

After the transfer is completed, the photosensitive drum 42 is cleaned by the cleaning device 423 and diselectrified by a diselectrifier not shown.

However, when it is detected by the first infrared detecting unit 51 that the toner image has no infrared reflectiveness, the image will not be transferred from the transfer device 421 to the sheet.

Figure 2:
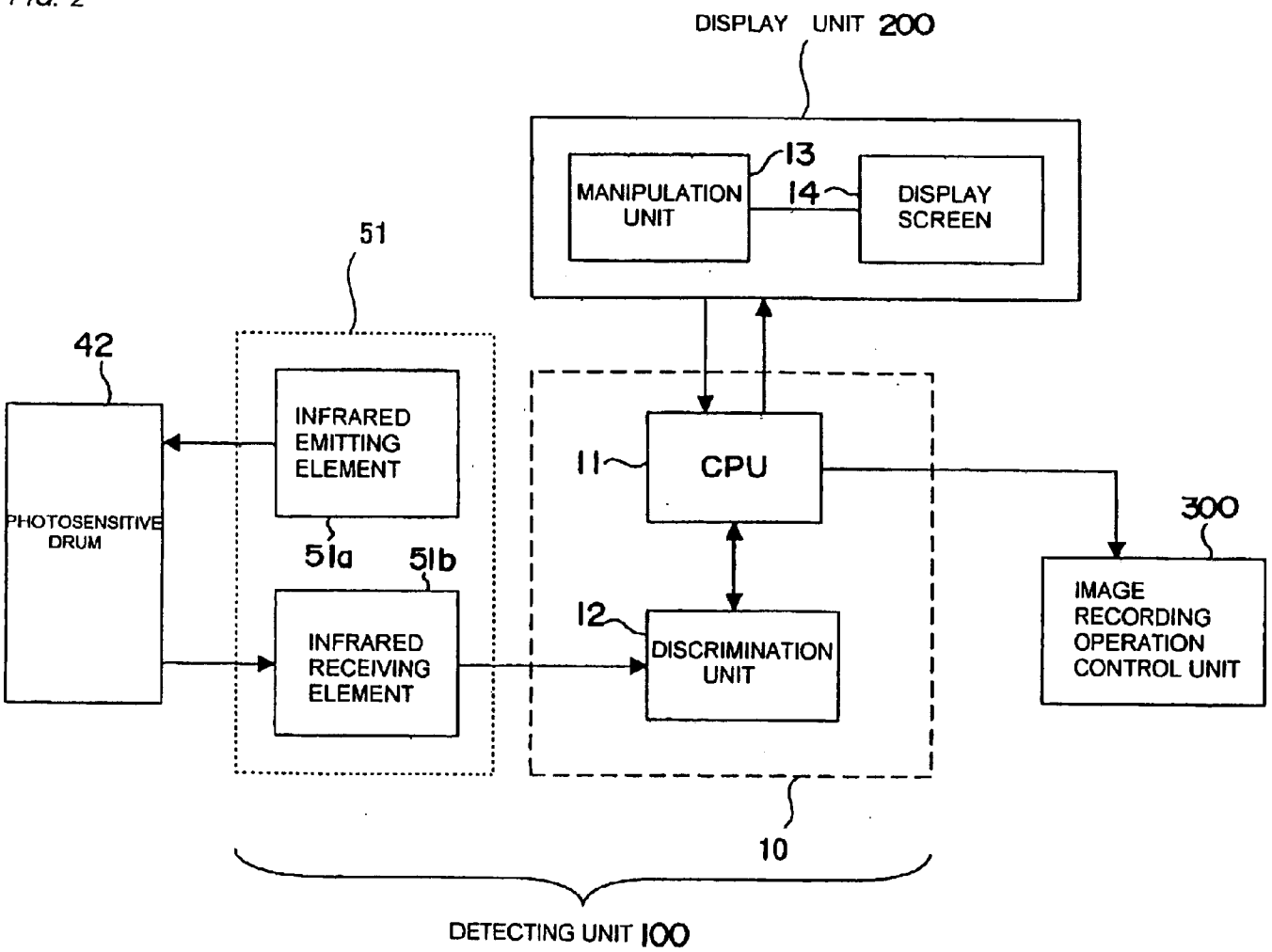
FIG. 2 is a block diagram explaining the configuration of a detecting unit according to the present invention.
Figure 3:
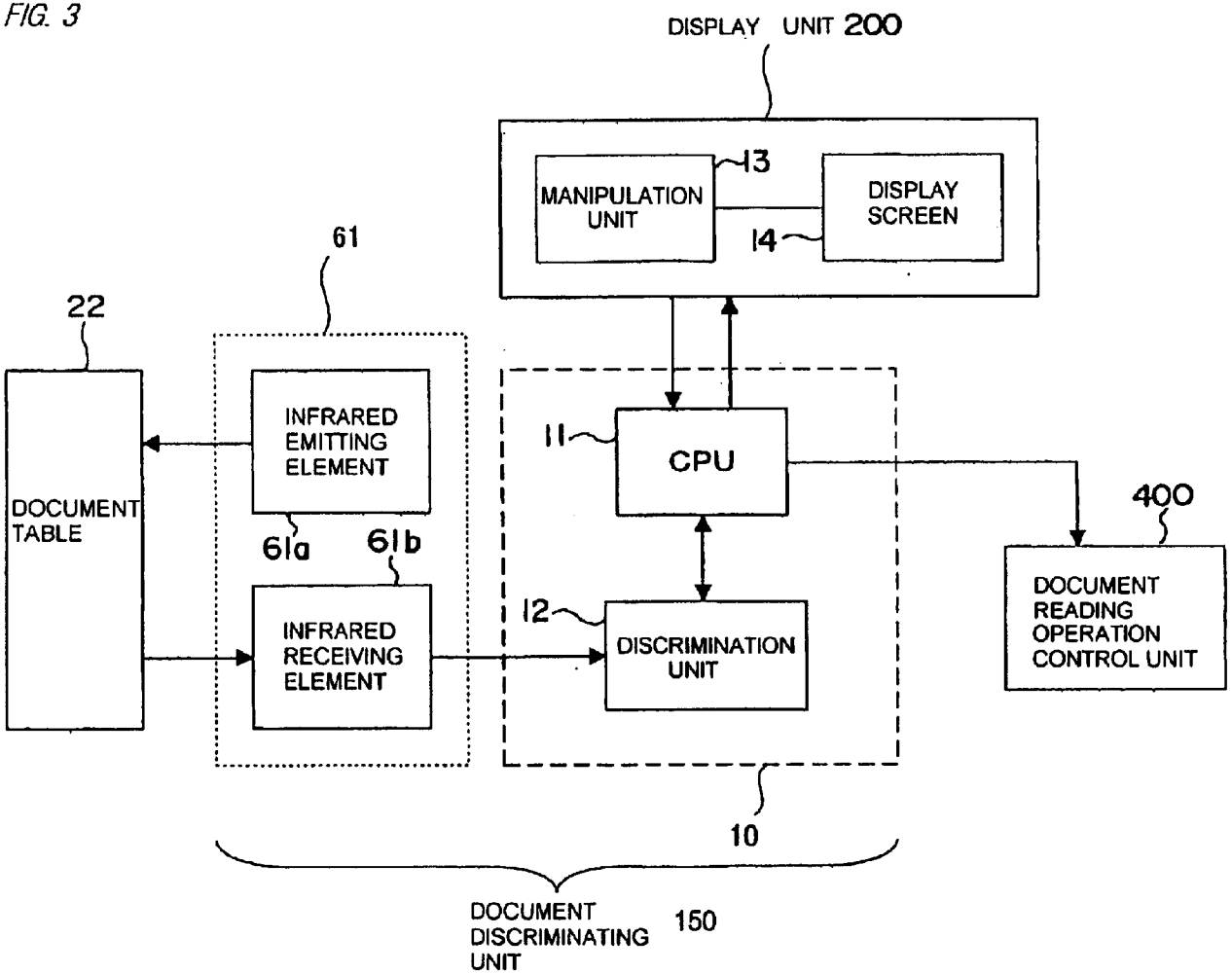
FIG. 3 is a block diagram explaining the configuration of a document detecting unit according to the present invention.

Next, FIG. 2 is referred to in explaining the method for detecting whether an object has infrared reflectiveness or not using the first infrared detecting unit 51. FIG. 2 is a block diagram showing the configuration of the means for detecting whether a black toner has infrared reflectiveness or not.

The means for detecting infrared reflectiveness is composed of a detecting unit 100 comprising a first infrared detecting unit 51, and a control unit 10 including a CPU 11 and a discrimination unit 12. The result of detection is either transmitted to a display unit 200 comprising a manipulation unit 13 and a liquid crystal display screen 14 with a manipulation key, or to an image recording operation control unit 300.

The detection of infrared reflective property is performed by radiating infrared light onto the toner image formed on the surface of the photosensitive drum 42 through the infrared emitting element 51*a* of the first infrared detecting unit 51. The infrared receiving element 51*b* detects reflection of infrared radiation from the toner image, or reflection of the infrared radiation output from the emitting element 51*a*. The result of detection at the infrared receiving element 51*b* is transmitted to a discrimination unit 12 within the machine control unit 10. The discrimination unit 12 determines whether infrared light was received by the infrared receiving element 51*b* or not, other words, whether the toner image formed on the photosensitive drum 421 contains an infrared reflective black toner or not. The result of discrimination is transmitted to a CPU 11, where based on the discrimination result, the CPU 11 sends a display demand signal to the display unit 200.

When it is judged by the discrimination unit 12 that the toner image is not formed of infrared reflective black toner, the CPU 11 demands the screen 14 of the display to show a message, such as "This toner is not a dedicated toner for the device, so it may be impossible to obtain an optimal image" or "This toner is not a dedicated toner for the device, so it will not be possible to distinguish the copy from the original".

Based on the displayed message, the user notices that the black toner stored in the toner casing 45 is not the toner dedicated for use by the present image forming device (that the toner has no infrared reflectiveness).

Further, the present image forming device 1 can be designed so as not to perform image forming when it is determined that the black toner being used does not have infrared reflectiveness.

That is, when it is determined that the black toner does not have infared reflectiveness, a message as exampled above is displayed on the screen of the display unit 200, and a demand signal for not performing the recording of image can transmitted from the CPU it to the image recording operation control unit 300.

It is possible to set up the device so that no images are formed by the present image forming device/using a non-dedicated toner (such as a normal carbon black toner).

According to this construction, the dedicated black toner having infrared reflectiveness can be used in the present image forming device 1 without fail, and the formed image will always have proper infrared reflectiveness. Since the copy formed by the present device has a unique optical property in that it reflects infrared radiation, the copy can be distinguished easily and accurately from the original.

Moreover, according to the present image forming device 1, the user can determine whether or not to perform image forming when a non-dedicated toner is used. In this case, when the user sets this mode through the display screen 14 and the manipulation unit 13, the CPU 11 executes control according to the set mode.

According to the present embodiment, whether or not the black toner has infrared reflectiveness or not is checked each time the image is being recorded on the recording medium (paper). However, it can be performed at other timings, such as when the image forming device 1 is warming up.

Another possible timing for checking infrared reflectiveness is when supplying black toner from the bottle, or when mounting the black toner cartridge to the device. In this case, the first infrared detecting unit is preferably disposed to the toner casing 45.

According further to the present invention, it is possible to provide a second infrared detecting unit 61 as the document discrimination unit to the image reading device 30 of the image forming device 1.

The infrared detecting unit 61 is composed of an infrared emitting element 61*a* and an infrared receiving element 61*b*. The second infrared detecting unit 61 is disposed at a location under the document table 22 where detection can be performed properly. The unit detects whether the document placed on the document table 22 has infrared reflectiveness or not before the document image is read in.

Next, with reference to FIG. 3, the structure of the means for detecting the infrared reflectiveness of the document by the second infrared detecting unit 61 will be explained. FIG. 3 is a block diagram showing the structure of the detecting unit for detecting whether or not the document has infrared reflectiveness.

The detection on whether or not the document has infrared reflectiveness is performed at a document discrimination unit 150 composed of the second infrared detecting unit 61 and a control unit 10 including a CPU 11 and a discrimination unit 12. The result of detection is sent either to a display unit 200 comprising a manipulation unit 13 and a liquid crystal display screen 14 including a manipulation key or to a document reading operation unit 400.

We will now explain how the detection on whether the document has infrared reflectiveness or not is performed.

When the document is mounted on the document platform 22, infrared radiation is radiated on the document through the infrared emitting element 61*a* before the document reading operation is started. The infrared receiving element 61*b* detects whether infrared light radiated from the infrared emitting element 61*a* is reflected by the document. Next, the result of detection by the receiving element 61*b* is transmitted to the discrimination unit 12 of the machine control unit 10. The discrimination unit 12 judge whether infrared radiation has been received by the infrared receiving element 61*b* that is, whether the document has been formed using infrared reflective black toner or not. The result of discrimination is sent to the CPU 11, where based on the result, the Cpu sends an order signal to the display unit.

When it is determined that the document utilizes infrared reflective black toner, the CPU 11 demands the screen 14 of the display to display a message, such as "This document contains infrared reflective toner." Based on this message, the user learns that the document comprises a black colored image having infrared reflectiveness, in other words, that the document is a copy formed using infrared reflective toner.

In case the image forming device is used to form images of a exit whose secondary copy must not be created, the secondary copying can be restricted by determining whether or not the document to be copied contains a black image having infrared reflectiveness. That is, in the image forming device, when the document discrimination unit 150 judges that the document image has infrared reflectiveness, the CPU 11 can be set so as to send out an order signal to stop operation of the image reading unit 30 to the document reading operation control unit 400. Thus, it is possible to prevent the formation of a secondary copy of a copied object formed using a black toner having infrared reflectiveness without fail. Therefore, the present embodiment advantageously prevent forgery of securities and bills.

Next, we will explain the black toner used in the present invention.

The black toner according to the present invention has an infrared reflective property. The black toner utilizes infrared-reflective black organic pigments. One actual example is an azomethine black organic pigment represented by the following general formula.

[Formula]

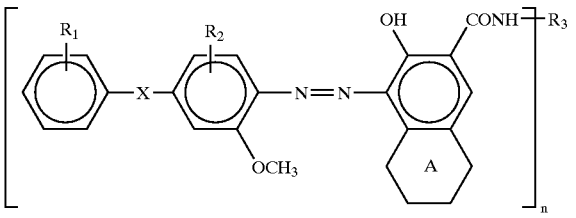

In the present embodiment, CHROMOFINE black A-1103 (trademark) manufactured by Dainichiseika Color & Chemicals Mfg. Co. Ltd. is used as one example of the infrared-reflective black organic pigment. This black toner is different from conventional black colored toner containing carbon black pigments in that it reflects infrared radiation and visually turns white. Therefore, when a copy is formed using this black toner, one can confirm easily and reliably whether the object is a copy formed using infrared-reflective black toner or not by exposing the object to infrared radiation and checking whether the black portion turns white or not.

Furthermore, the present black toner should preferably contain as binder resin at least one material selected from the group consisting of polyester, styrene acrylic butadiene copolymer polystyrene, polyurethane, polyethylene and polypropylene. According to this construction, the infrared-reflective black organic pigments have good dispersibility and pigmentation property to the binder resin. Further, the obtained toner has advantageous electrostatic property and developing property.

According to the present black toner, the ratio of the infrared-reflective black organic pigments should be 0.5 to 15 percent by weight to the binder resin. Thus, the infrared-reflective black organic pigments have better dispersibility and pigmentation property to the binder resin.

Figure 4:
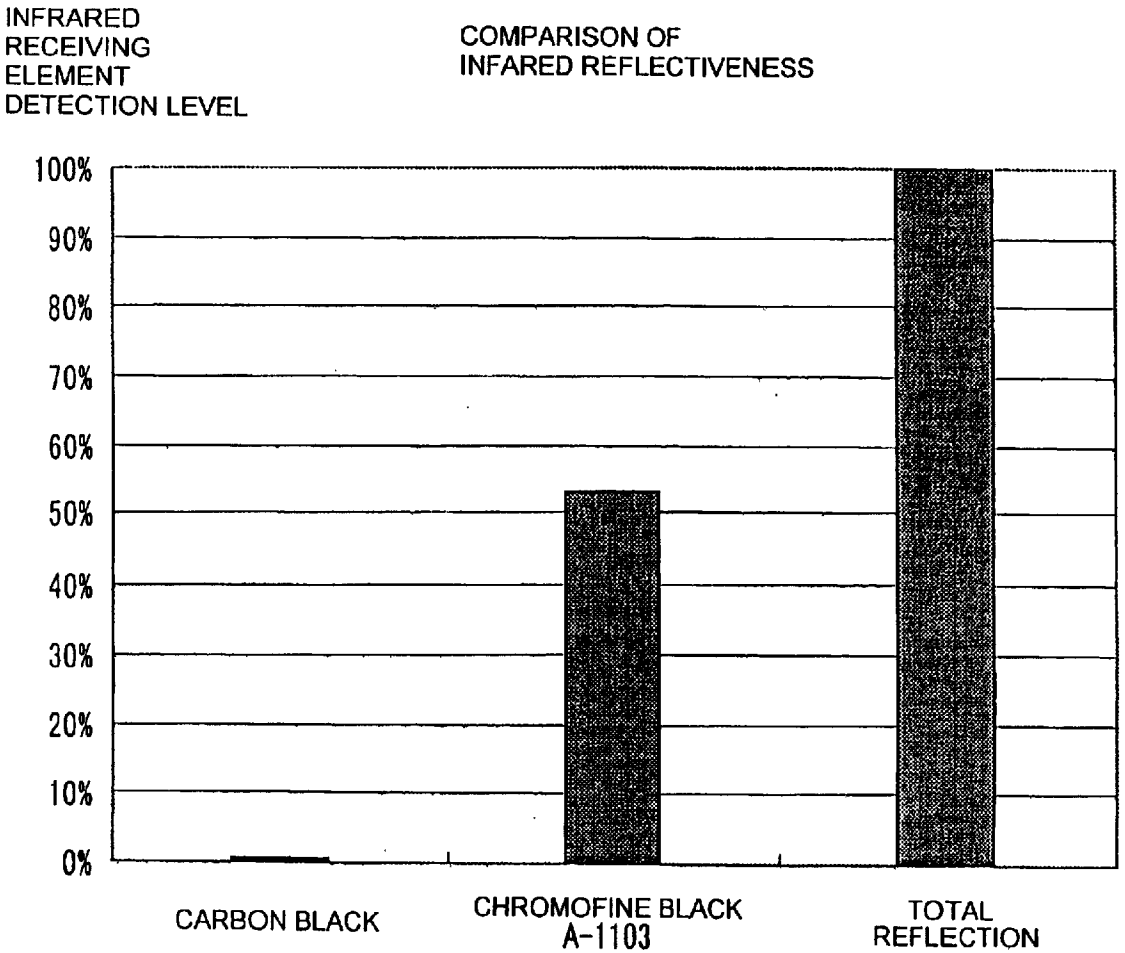
FIG. 4 is a graph showing the infrared reflective property.

Next, the infrared reflective property of the black toner according to the present invention will be explained with reference to FIG. 4 illustrating comparative examples.

FIG. 4 illustrates the detection level of infrared light by the infrared receiving element of a conventional carbon black and a toner containing 5 percent by weight of infrared-reflective organic pigments to the binder polyester resin. According to this graph, detection level 100% corresponds to total reflection. In the present example, the wavelength of the infrared emitting element is set to 800 nm, since the present infrared-reflective black organic pigment has highest reflectance to this wavelength.

As illustrated in the graph, it is confirmed that the toner having infrared-reflective black organic pigment (the toner according to the present invention) has significantly high infrared reflective property compared to the conventional carbon black.

In the present embodiment, an image forming device for forming a single black color image is taken as an example, but the present invention is not limited to such example. The present invention can be applied to an image forming device for forming color images using black, yellow, magenta and cyan toners.

As explained, the present invention provides an image forming device capable of forming images using a black toner having an optical property to reflect infrared radiation, so that the formed copy can be discriminated easily from the original. This is advantageous since infrared radiation can be easily handled. Further, the present device is capable of preventing erroneous use of black toners for other image forming devices that have no infrared reflectiveness.

What is claimed is:

1. An image forming device for forming an image by transferring and fixing a toner image on a recording medium, comprising:

a reader for reading a document image, an electrostatic latent image forming unit for converting the obtained image data into an electrostatic latent image, an electrophotographic processing unit for using the electrostatic latent image to form a toner image, and a control unit;

wherein said electrophotographic processing unit comprises a developing agent comprising an azomethine black organic pigment, and the formed image as infrared reflective property.

2. A black toner to be used in the image forming device according to claim 1, comprising a black organic pigment and a binder resin, said black organic pigment containing an azomethine black organic pigment having infared reflective property.

3. A black toner according to claim 2, wherein said binder resin comprises at least one material selected from the group consisting of polyester, styrene acrylic butadiene copolymer polystyrene, polyurethane, polyethylene and polypropylene.

4. A black toner according to claim 3, wherein the ratio of said black organic pigment having infrared reflective property to said binder resin is between 0.5 and 15 percent by weight.

5. An image forming device for forming image by transferring and fixing a toner image on a recording medium, comprising:

a reader for reading a document image, an electrostatic latent image forming unit for converting the obtained image data into an electrostatic latent image, an electrophotographic processing unit for using the electrostatic latent image to form a toner image, and a control unit, wherein said electrophotographic processing unit comprises a developing agent comprising a black toner having infrared reflective property, and a detector for detecting whether said toner image formed by the electrophotographic processing unit has infrared reflective property or not; and said control unit controls the operation of at least one unit of the image forming device based on a result of detection by the detector.

6. An image forming device according to claim 5, further comprising a display unit for displaying the result of detection by the detector.

7. An image forming device according to claim 5, wherein said document image reader comprises a document detector for detecting whether the image of the document has infrared reflective property or not, and said control unit controls a display unit to display the result of detection by said document detector.

8. A black toner to be used in the image forming device according to claim 5, comprising black organic pigment and a binder resin, said black organic pigment containing an azomethine black organic pigment having infared reflective property.

9. A black toner according to claim 8, wherein said binder resin comprises at least one material selected from the group consisting of polyester, styrene acrylic butadiene copolymer polystyrene, polyurethane, polyethylene and polypropylene.

10. A black toner according to claim 9, wherein the ratio of said black organic pigment having infrared reflective property to said binder resin between 0.5 and 15 percent by weight.

11. A copy comprising an image formed by a developing agent containing black organic pigment having infrared reflective property, said copy capable of being discriminated from a copy formed by a developing agent containing normal black organic pigment by reflecting infrared light.

12. An image forming device for forming an image by transferring and fixing a toner image on a recording medium, comprising:

a reader for reading a document image;

an electrostatic latent image forming unit for converting the obtained image data into an electrostatic latent image;

an electrophotographic processing unit for using the electrostatic latent image to form a toner image;

a detecting unit for making a determination whether an irradiated image has an infrared reflective property and which generates a signal in accordance with the determination;

wherein the electrophotographic processing unit utilizes an azomethine black organic pigment to form the toner image, and wherein the document has the infrared reflective property.

13. The image forming device of claim 12, wherein the signal provides an indication whether the irradiated image has the infared reflective property.

14. The image forming device of claim 13, further comprising a display unit, and wherein the signal is applied to the display unit so that the display unit can provide an indication whether the irradiated image has the infrared reflective property.

15. The image forming device of claim 12, wherein the signal is utilized to control replication or not of the toner image on the recording medium.

16. The image forming device of claim 12, wherein the irradiated image is the document image, and wherein the detecting unit is situated proximate the reader for radiating infrared radiation on the document image and for detecting infrared radiation reflected by the document image.

17. An image forming device for forming an image by transferring and fixing a toner image on a recording medium, comprising:

a reader for reading a document image;

an electrostatic latent image forming unit for converting the obtained image data into an electrostatic latent image;

an electrophotographic processing unit for using the electrostatic latent image to form a toner image;

a first detecting unit for making a determination whether the toner image has an infrared reflective property and which generates a first signal in accordance with the determination;

a second detecting unit for making a determination whether the document image has an infrared reflective property and which generates a second signal in accordance with the determination;

a control unit for utilizing either the first signal or second signal either to provide an indication or to preclude formation of a further image on the recording medium.

18. The image forming device of claim 17, wherein at least one the first signal and the second signal provides an indication whether either the toner image or the document image has the infrared reflective property.

19. The image forming device of claim 18, further comprising a display unit, and wherein at least one of the first signal and the second signal is applied to the display unit so that the display unit can provide indication regarding the infrared reflective property.

20. The image forming device of claim 17, wherein at least one of the first signal and the second signal is utilized to control replication or not of the toner image on the recording medium.

21. The image forming device of claim 17, wherein the electrophotographic processing unit comprises a photosensitive drum, and wherein the first detecting unit is situated proximate the photosensitive drum for radiating infrared radiation on the toner image formed on the photosensitive drum and for detecting infrared radiation reflected by the toner image.

22. The image forming device of claim 17, wherein the second detecting unit is situated proximate the reader for radiating infrared radiation on the document image and for detecting infrared radiation reflected by the document image.

23. The image forming device of claim 17, wherein the electrophotographic processing unit utilizes an azomethine black organic pigment to form the toner image, and wherein the document image has the infrared reflective property.

24. The image forming device of claim 17, wherein the first detecting unit makes the detection with respect to each attempted replication of the toner image on the recording medium.

25. The image forming device of claim 17, wherein the first detecting unit makes the detection upon commencement of a new supply of toner.

26. An image forming device for forming an image by transferring and fixing a toner image on a recording medium, comprising:

a reader for reading a document image;

an electrostatic latent image forming unit for converting the obtained image data into an electrostatic latent image;

an electrophotographic processing unit for using the electrostatic latent image to form a toner image;

a toner casing which contains toner for making the toner image;

a detecting unit which is disposed proximate the toner casing for detecting an infrared reflective property of the toner, wherein the detecting unit makes a determination based on an infrared reflective property of the toner and generates a signal in accordance with the determination, and wherein the detecting unit makes a positive determination when the toner comprises an azomethine black organic pigment.

* * * * *